US007370447B2

(12) United States Patent
Carlin et al.

(10) Patent No.: US 7,370,447 B2
(45) Date of Patent: May 13, 2008

(54) DISPLAY DEVICE

(75) Inventors: Glenn Carlin, Kent, CT (US); Gilbert Aviles, Kent, CT (US)

(73) Assignee: Crew Design Incorporated, Kent, CT (US)

( * ) Notice: Subject to any disclaimer, the term of this patent is extended or adjusted under 35 U.S.C. 154(b) by 69 days.

(21) Appl. No.: 11/221,649

(22) Filed: Sep. 7, 2005

(65) Prior Publication Data

US 2007/0051025 A1 Mar. 8, 2007

(51) Int. Cl.
*G09F 15/00* (2006.01)

(52) U.S. Cl. ..... 40/610; 40/787; 40/539

(58) Field of Classification Search ..... 40/124.08, 40/539; 446/148, 488, 487
See application file for complete search history.

(56) References Cited

U.S. PATENT DOCUMENTS 3,727,874 A * 4/1973 Wuensch ..... 248/459
4,901,911 A * 2/1990 Drexhage ..... 229/114
5,454,180 A * 10/1995 Volpe ..... 40/539
5,682,999 A * 11/1997 Larson ..... 206/768
6,199,308 B1 * 3/2001 Westendorp ..... 40/124.08
6,508,023 B2 * 1/2003 Moss et al. ..... 40/610
7,159,351 B2 * 1/2007 Sparkowski ..... 40/610

* cited by examiner

*Primary Examiner*—Cassandra Davis
(74) *Attorney, Agent, or Firm*—McCormick, Paulding & Huber LLP

(57) ABSTRACT

A display device comprises a flexible body portion including an upper portion, a lower portion and a base portion. The upper and lower portions adjoin one another by a periphery adapted to permit pivoting of the upper and lower portions so as to be generally folded against one another when in a collapsed condition, and to permit pivoting of the upper and lowers portion away from one another when in an assembled condition. The lower and base portions adjoin one another by a periphery adapted to permit pivoting of the lower portion and the base portion so as to be generally folded against one another when in a collapsed condition, and to permit pivoting of the lower portion and the base portion away from one another when in an assembled condition such that the base portion supports the upper portion and the lower portion in a generally upright orientation.

9 Claims, 2 Drawing Sheets
(2 of 2 Drawing Sheet(s) Filed in Color)

DISPLAY DEVICE

FIELD OF THE INVENTION

This invention relates generally to devices for displaying advertisements or other messages, and more particularly to an erectable and collapsible display device.

BACKGROUND OF THE INVENTION

Erectable and collapsible display devices typically includes components which are foldable for storage and which can be unfolded into an assembled condition. Such display devices typically have graphics, such as advertisements, on the front portion of the display. A drawback with such displays is the complexity of parts needed to assemble and maintain the display in an assembled condition. Moreover, such displays are typically formed from B-flute corrugated cardboard which is too stiff to be curved into imaginative forms such as three-dimensional shapes. As a result, the front of a conventional display is a two-dimensional surface which limits the viewing angle as opposed to a display having a front surface which can be curved into a convex or other three-dimensional shape. Further, printing graphics to corrugated cardboard cannot usually be done directly but rather involves several steps including first printing to a litho and then mounting to paper or a B-flute corrugated cardboard material used in the display.

Accordingly, it is an object of the present invention to provide a display device that overcomes the above-mentioned drawbacks and disadvantages.

SUMMARY OF THE INVENTION

In an aspect of the present invention, an erectable and collapsible display device comprises a flexible body portion including an upper portion, at least one lower portion and a base portion. The upper portion and the lower portion adjoin one another by a periphery adapted to permit pivoting of the upper portion and the lower portion so as to be generally folded against one another when in a collapsed condition, and to permit pivoting of the upper portion and the lower portion away from one another when in an erected or assembled condition. The lower portion and the base portion adjoin one another by a periphery adapted to permit pivoting of the lower portion and the base portion so as to be generally folded against one another when in a collapsed condition, and to permit pivoting of the lower portion and the base portion away from one another when in an assembled condition such that the base portion supports the upper portion and the lower portion in a generally upright orientation.

BRIEF DESCRIPTION OF THE DRAWINGS

"The patent or application file contains at least one drawing executed in color. Copies of this patent or patent application publication with color drawing(s) will be provided by the Office upon request and payment of the necessary fee."

DETAILED DESCRIPTION OF THE PREFERRED EMBODIMENT

Figure 1:
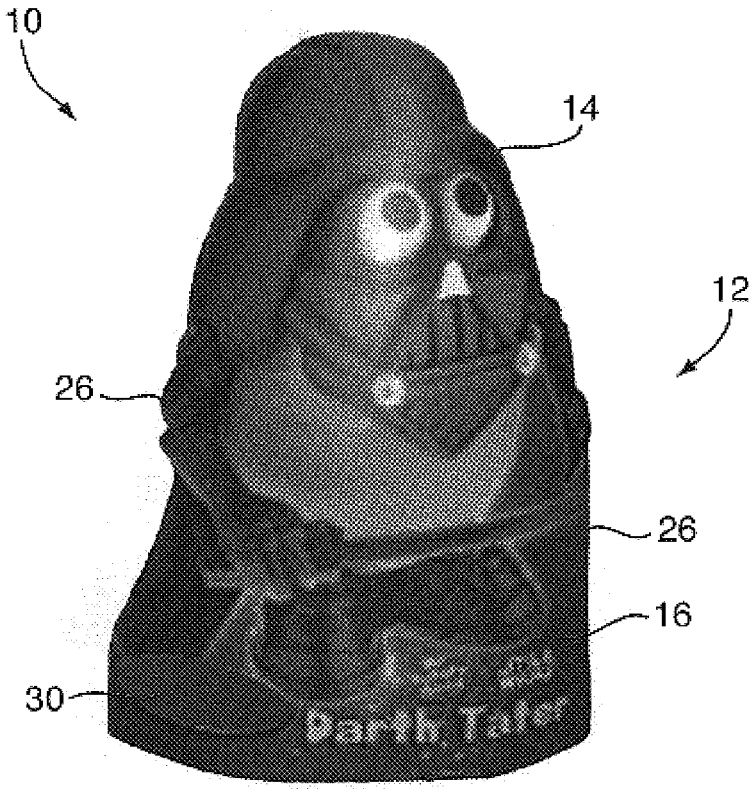
FIG. 1 is a front perspective view of an erected or fully assembled display device embodying the present invention.

Referring to FIGS. 1-5 an erectable and collapsible display device embodying the present invention is indicated generally by the reference number 10. The display device 10 comprises a flexible body portion 12 for permitting the display device to fold into a collapsed condition and to unfold or open into an erected or assembled condition.

The flexible body portion 12 includes an upper portion 14, at least one lower portion 16, and a base portion 18. The upper portion 14 and the lower portion 16 adjoin one another by a periphery 20, preferably a folded periphery, adapted to permit pivoting of the upper portion and the lower portion so as to be generally folded against one another when in a collapsed condition, and to permit pivoting of the upper portion and the lower portion away from one another when in an assembled condition. Likewise, the lower portion 16 and the base portion 18 adjoin one another by a periphery 22 adapted to permit pivoting of the lower portion and the base portion so as to be generally folded against one another when in a collapsed condition, and to permit pivoting of the lower portion and the base portion away from one another when in an assembled condition such that the base portion supports the upper portion and the lower portion in a generally upright orientation.

Preferably, the body portion 12 is fabricated from a point board material in the range of 20-24 point to permit the body portion to flex and stiffen when in the assembled condition. The stiffened body portion 12 prevents gravity from causing the upper portion 14 to pivot or otherwise collapse downwardly against the lower portion 16 under the influence of gravity. Moreover, fabrication of the body portion 12 from a 20-24 point board material permits direct printing on the board material with a four color process, thereby saving the step of printing to litho and then mounting to conventional display materials such as paper or a B-flute corrugated cardboard.

Figure 2:
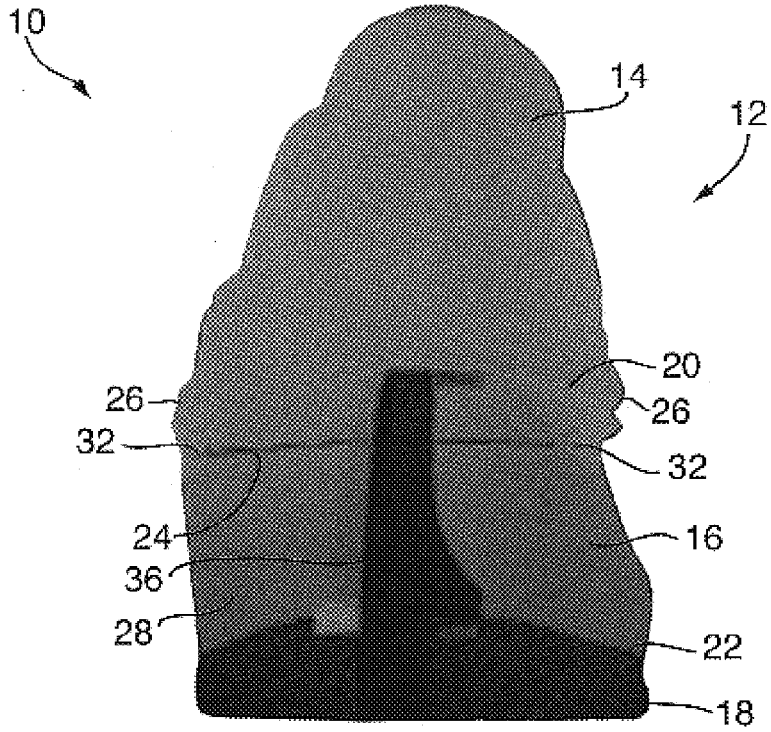
FIG. 2 is a rear view of the assembled display device.

The display device 10 includes a resilient member 24 coupled to lateral edges 26 of a rear surface 28 of the body portion 12 such as, for example, the lower portion 16 as shown in FIG. 2. The resilient member 24 is in tension when the body portion 12 is in an assembled condition to enable a front surface 30 of the body portion to flex frontward into a convex or three-dimensional shape as shown in FIG. 1. Preferably, the resilient member 24 is a braided shock cord which is more durable than rubber band type elastic that is typically used with assembled displays. The display device 10 can include support tabs 32 extending from the lateral edges 26 of the body portion 12 for anchoring longitudinal ends of the resilient member 24.

The display device 10 further comprises an easel or bracket 36 pivotally coupled to the rear surface 28 of the lower portion 16 so as to be generally folded against the lower portion when in a collapsed condition, and such that one edge 38 abuts the lower portion 16 and another edge 40 abuts the base portion 18 to brace the body portion 12 when in an assembled condition. Thus, the base portion 18 and the bracket 36 cooperate to form a substructure support for the body portion 12 when in the assembled condition.

Preferably, the bracket 36 defines a hole 42 therethrough. The resilient member 24 extends through the hole 42 of the bracket 36 and is coupled at the longitudinal ends to the support tabs 32 at the lateral edges 26. When the bracket 36 folded against the lower portion 16 is pivoted away from the lower portion and into the assembled condition, the hole 42 and a portion of the resilient member 24 extending therethrough move away from the lower portion and thereby stretch and create tension in the resilient member. The stretched resilient member 24 pulls the lateral edges 26 of the body portion 12 in a rearward direction so as to cause the front surface 30 of the body portion to flex into a convex or three-dimensional shape when in an assembled condition. When the display device 10 is in the assembled condition, the convex shape of the front surface 30 of the body portion 12 allows for greater viewing angles and dimensional quality with respect to any graphics disposed thereon and three-dimensional die cut. Moreover, the ability of the upper portion 14 to be folded against the lower portion 16, and the bracket 36 to be folded against the lower portion 16 when the display device 10 is in the collapsed condition allows for compact and cost effective shipping, as well as "one handed" automatic set up of the display device.

Figure 3:
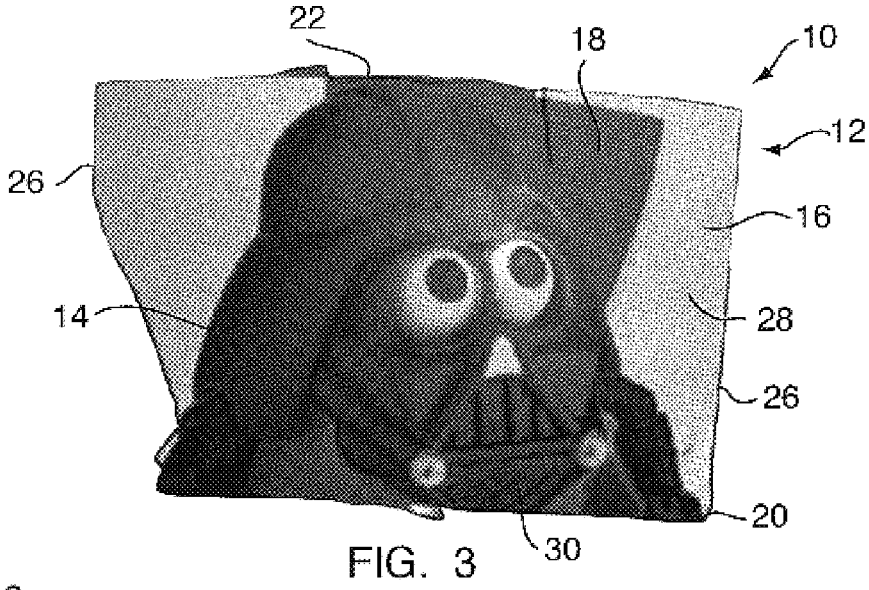
FIG. 3 is a front view of the display device in a fully collapsed condition.
Figure 4:
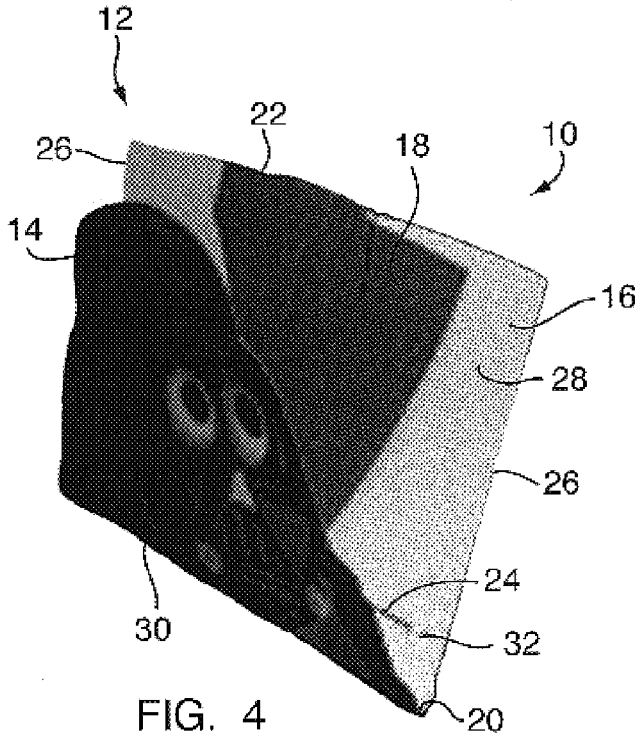
FIG. 4 is a front perspective view of the display device in a partially assembled condition.
Figure 5:
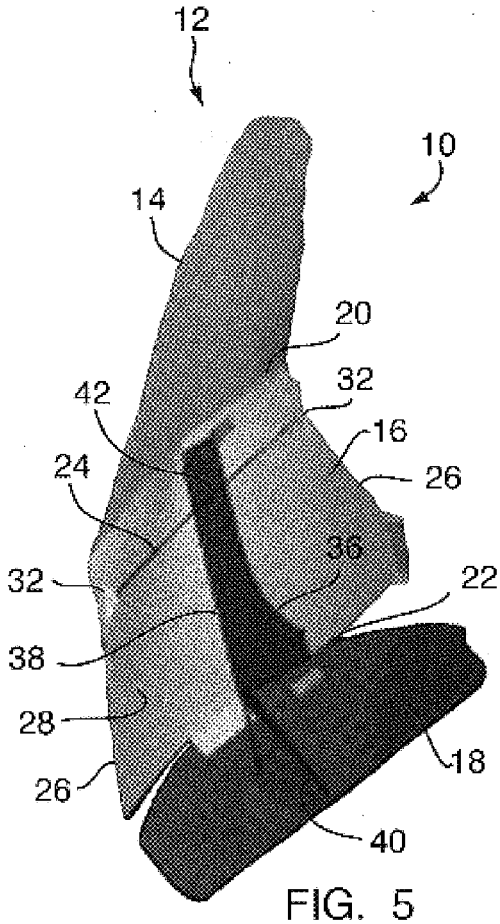
FIG. 5 is a rear perspective view of the display device in a further partially assembled condition.

In operation, the display device 10 when in a collapsed condition has the upper portion 14 and the base portion 18 folded against the lower portion 16 as shown in FIG. 1. To change the display device 10 from a collapsed condition to an assembled condition, the upper portion 14 and the lower portion 16 are pivoted away from each other as shown in FIG. 2. Similarly, the base portion 18 is pivoted away from the lower portion 16 as shown in FIG. 3. The bracket 36 folded against the lower portion 16 is then pivoted away from the lower portion such that one edge 38 abuts the lower portion and another edge 40 abuts the base portion 18 to brace the body portion 12 in an upright orientation.

As the bracket 36 is being pivoted away from the lower portion 16, the resilient member 24 extending through the hole 42 defined by the bracket is stretched so as to pull the lateral edges 26 of the body portion 12 rearwardly and thereby cause the front surface 30 of the body portion to flex and stiffen into a convex or three-dimensional shape. The stiffening of the body portion 12 when in the assembled condition prevents the upper portion 14 from pivoting or otherwise collapsing downwardly against the lower portion 16 under the influence of gravity. To change the display device 10 from an assembled condition to a collapsed condition, the above-mentioned steps for assembling the display device are generally reversed.

As will be recognized by those of ordinary skill in the pertinent art, numerous modifications and substitutions can be made to the above-described embodiment of the present invention without departing from the scope of the invention. Accordingly, the preceding portion of this specification is to be taken in an illustrative, as opposed to a limiting sense.

What is claimed is:

1. An erectable and collapsible display device comprising:

a flexible body portion including:

an upper portion;

at least one lower portion, the upper portion and the at least one lower portion adjoining one another by a periphery adapted to permit pivoting of the upper portion and the at least one lower portion so as to be generally folded against one another when in a collapsed condition, and to permit pivoting of the upper portion and the at least one lower portion away from one another when in an assembled condition;

a base portion, the at least one lower portion and the base portion adjoining one another by a periphery adapted to permit pivoting of the at least one lower portion and the base portion so as to be generally folded against one another when in a collapsed condition, and to permit pivoting of the at least one tower portion and the base portion away from one another when in an assembled condition such that the base portion supports the upper portion and the at least one lower portion in a generally upright orientation; and a resilient member coupled to lateral edges of a rear surface of the body portion, the resilient member being in tension when the body portion is in the assembled condition and generally upright orientation to enable a front surface of the body portion to flex into a convex shape.

2. A display device as defined in claim 1, further including support tabs extending from the lateral edges of the body portion for anchoring ends of the resilient member.

3. A display device as defined in claim 1, wherein the resilient member includes a braided shock cord.

4. A display device as defined in claim 1, wherein the periphery adjoining the upper portion and the at least one lower portion is a folded periphery.

5. A display device as defined in claim 1, wherein the periphery adjoining the at least one lower portion and the base portion is a folded periphery.

6. An erectable and collapsible display device comprising:

a flexible body portion including:

an upper portion;

at least one lower portion, the upper portion and the at least one lower portion adjoining one another by a periphery adapted to permit pivoting of the upper portion and the at least one lower portion so as to be generally folded against one another when in a collapsed condition, and to permit pivoting of the upper portion and the at least one lower portion away from one another when in an assembled condition;

a base portion, the at least one lower portion and the base portion adjoining one another by a periphery adapted to permit pivoting of the at least one lower portion and the base portion so as to be generally folded against one another when in a collapsed condition, and to permit pivoting of the at least one lower portion and the base portion away from one another when in an assembled condition such that the base portion supports the upper portion and the at least one lower portion in a generally upright orientation;

a bracket pivotally coupled to a rear surface of the at least one lower portion so as to be generally folded against the at least one lower portion when in a collapsed condition, and such that one edge abuts the at least one lower portion and another edge abuts the base portion to brace the body portion when in an operative condition, the bracket defining a hole therethrough; and a resilient member extending through the hole of the bracket and coupled to lateral edges of a rear surface of the body portion to enable a front surface of the body portion to flex into a convex shape when the body portion is in the assembled condition and upright orientation.

7. A display device as defined in claim 6, wherein the resilient member includes a braided shock cord.

8. A display device as defined in claim 6, wherein the periphery adjoining the upper portion and the at least one lower portion is a folded periphery.

9. A display device as defined in claim 6, wherein the periphery adjoining the at least one lower portion and the base portion is a folded periphery.

* * * * *

UNITED STATES PATENT AND TRADEMARK OFFICE

CERTIFICATE OF CORRECTION

PATENT NO. : 7,370,447 B2
APPLICATION NO. : 11/221649
DATED : May 13, 2008
INVENTOR(S) : Glenn Carlin It is certified that error appears in the above-identified patent and that said Letters Patent is hereby corrected as shown below:

Column 4, claim 1, line 1 please delete the word "tower" and replace with the word --lower--.

Signed and Sealed this

Twelfth Day of August, 2008

JON W. DUDAS
*Director of the United States Patent and Trademark Office*